United States Patent [19]

Luke

[11] Patent Number: 4,977,908

[45] Date of Patent: Dec. 18, 1990

[54] TOBACCO RECONSTITUTION

[75] Inventor: John A. Luke, Eastleigh, England

[73] Assignee: British-American Tobacco Company

[21] Appl. No.: 158,512

[22] Filed: Feb. 22, 1988

[30] Foreign Application Priority Data

Feb. 23, 1987 [GB] United Kingdom ..... 8704196

[51] Int. Cl.[5] ..... A24B 3/14

[52] U.S. Cl. ..... 131/375; 131/355

[58] Field of Search ..... 131/375, 359, 369, 353, 131/355

[56] References Cited

U.S. PATENT DOCUMENTS

| | | | |
|---|---|---|---|
| 3,373,751 | 3/1968 | Wallberg | 131/375 |
| 3,528,434 | 9/1970 | Halter et al. | 131/355 |
| 4,164,948 | 8/1979 | Beringer et al. | 131/375 |
| 4,730,629 | 3/1988 | Graves et al. | 131/375 |
| 4,770,194 | 9/1988 | Ohashi et al. | 131/375 |

FOREIGN PATENT DOCUMENTS

| | | | |
|---|---|---|---|
| 0045914 | 4/1985 | Japan | 131/375 |

*Primary Examiner*—V. Millin

[57] ABSTRACT

Tobacco is reconstituted to provide a product of tobacco-filler size particles. Particulate tobacco, from 5 to 10 weight percent of starch, up to 10 weight percent binder and water are fed to an extruder, the operating conditions being such that in the sheet form extrudate water flashes off to steam, thus to expand the extrudate. Further, the cross-section of the extrudate when exiting the orifice of the extruder expands to a cross-section greater than that of the orifice of the extruder. After being cooled, the extrudate is cut to particle size. The particles, each of which comprises a cellular interior and a skin at two opposite sides, can be used as or in cigarette filler.

17 Claims, 1 Drawing Sheet

1
2
3
4
5
6
7
8
9
10
11
12
13
14
15
16
17
18
19
20
21
22
23
24
25
26
27
28
29
30
31
32

TOBACCO RECONSTITUTION

The invention the subject of this application relates to tobacco reconstitution.

There have been many prior proposals for the production of tobacco based material utilising particulate tobacco. According to these proposals, the particulate tobacco may be derived from a waste product of smoking article manufacturing processes, cigarette manufacturing processes for example, or may be obtained by grinding tobacco leaf lamina or stem portions. The materials produced from the particulate material may take the form of flat webs or sheets, rods, filaments or hollow cylinders. Processes producing these materials are commonly referred to as tobacco reconstitution processes.

It has been proposed to operate tobacco reconstitution processes to produce materials which can be used as smoking articles. Thus if the material is produced as a rod of open cell structure, of 8 mm. diameter say, it has been suggested that the rod can be smoked as a smoking article having a likeness to a cigarette or a cigar. It has though more usually been proposed that the products of tobacco reconstitution processes should be utilised, after having been cut or shredded, as constituents of cut filler for conventional smoking articles. A further use for reconstituted tobacco materials, when in web or sheet form, is as smoking article wrapping materials.

Components additional to tobacco which have been proposed for inclusion in materials produced by reconstitution processes are water; binding agents, e.g. pectin, starch, pullulan and cellulosic binders; fillers; humectants; expansion agents; reinforcing agents; and flavorants.

Tobacco reconstitution processes may be carried out by subjecting the particulate tobacco and other component materials to a casting process, to an extrusion process or to a paper-making type process.

Details of prior proposed tobacco reconstitution processes are to be found in the patent specifications next listed.

Australian Patent Specification No. 499,651.

Canadian Patent Specification Nos. 711,529; 951,209; and 1,163,069.

European Patent Specifications Nos. 056,308, 113,595; 143,335, 167,370, 198,718, 208,566 and 238,298.

United Kingdom Patent Specifications Nos. 5367/98; 983,928; 1,013,303; 1,055,455; 1,059,470; 1,138,280; 1,234,786; 1,502,797; and 2,078,087A.

U.S. Pat. Nos. 2,592,553; 3,098,492 and 3,166,078.

Smoking related defects which have been noted in the product materials of prior tobacco reconstitution processes relate to factors such as taste, flavour, aroma, colour, ash and burn characteristics, density, resilience and frangibility. In the use of such materials as constituents of smoking article filler, there has been noted the defect of low filling power as compared with orthodox cut leaf tobacco. A further defect noted in materials from prior reconstitution processes is poor appearance.

It is an object of the present invention to provide a tobacco reconstitution process by which there may be produced materials which in smoking qualities closely resemble those of the tobacco from which the material derives.

It is another object of the present invention to provide a tobacco reconstitution process by which there may be produced material of good colour and a general appearance closely resembling cut leaf tobacco.

It is a further object of the present invention to provide a tobacco reconstitution process by which there may be produced material of filling power at least equivalent to that of cut leaf tobacco.

It is yet another object of the present invention to provide a tobacco reconstitution process by which there may be produced a cut material which is resilient and which resists degradation.

It is yet another object of the present invention to provide a tobacco reconstitution process by which there may be produced materials which can be blended with natural tobacco cigarette filler at the conclusion of the primary processing steps of tobacco filler manufacture.

The present invention provides a tobacco reconstitution process, wherein a mixture of particulate tobacco, starch and binder, of which mixture starch constitutes 5% to 35% by weight, binder constitutes up to 10% by weight and the amount of starch is, by weight, twice or more the amount of binder, with the addition of sugar within a range of 0% to 10% by weight of said mixture, and with the addition of water, is extruded, to provide a sheet form extrudate, under such extrusion conditions that the extrudate assumes a cross-section greater than that of the exit orifice of the extruder die, and the extrudate is cut to provide a product of tobacco-filler size particles.

The starch is preferably present in the tobacco/starch/binder mixture at a level within a range of 10% to 30% by weight and is preferably present in the mixture in an amount by weight exceeding that of binder by three or more times. The level of binder in the mixture preferably does not exceed 5% by weight.

The starch may, for example, be maize or corn starch. The starch, or a proportion thereof up to 100% , may be a modified starch.

Suitably, the binder comprises a cellulosic binder. Preferred cellulosic binder materials for use in practising the present invention are hydroxypropyl cellulose and carboxymethyl cellulose, the former being found to be especially effective. Other suitable cellulosic binder materials are hydroxyethyl cellulose, methyl cellulose and ethyl cellulose. Further suitable cellulosic binder materials will readily occur to those knowledgeable of prior proposed tobacco reconstitution processes. The binder of the tobacco/starch/binder mixture may be provided by two or more binder materials, in which case it is advantageous that one of these materials is hydroxypropyl cellulose.

The sugar, if present, may comprise one or more sugars, such for example as fructose, glucose and sucrose. Suitably, the sugar is present at a level not exceeding about 5% by weight of the tobacco/starch/binder mixture.

Advantageously, the total water present in the extruder is such that, without an extrudate drying step being utilised, the moisture content of the cut extrudate is within a range of 5% to 20% by weight (wet basis) and more preferably within a range of 10% to 16% by weight (wet basis). By "total water" is meant the sum of any moisture present in the "dry" components fed to the extruder plus any added water. Water may be added to one or more of the components of the mixture before the components are fed to the extruder and/or by way of injection via a barrel port(s) of the extruder barrel. A convenient practice is to mix the components of the mixture and then to feed the mixture in a dry or substantially dry state to the extruder, water being added by injection into the extruder barrel.

Suitably, a plasticiser, such for example as glycerol or propylene glycol is fed to the extruder with the components of the above referred to mixture and/or by way of injection into the extruder barrel. The inclusion level of the plasticiser may be within a range of 1 to 10% by weight on a wet basis.

We have found that products with optimised characteristics are obtained by ensuring that the processing within the extruder of the materials fed thereto takes place adiabatically or close to adiabatically. It is also important to operate with an extruder barrel temperature profile up to the extruder die such that the temperature of the tobacco portion of the materials in the extruder does not attain a value which would be deleterious to the tobacco and is suitably in a range of 80° C. to 180° C.

The processing must take place under such conditions that immediately upon it issuing from the die, the extrudate is expanded by water therein flashing off to steam. There is thereby effected an increase in the cross-section of the extrudate and the establishment of a cellular interior structure. The density of the extrudate may be in a range of 50 mg/cc to 500 mg/cc, and preferably not more than 300 mg/cc.

We have also found it to be advantageous to draw down the sheet form extrudate, so effecting an increase in the machine direction dimension of the extrudate and a decrease in the thickness thereof. By drawing down the extrudate an orientation is imparted thereto and there may be produced cut product of enhanced strength and flexibility.

The draw down ratio, i.e. the ratio of the machine direction velocity imparted to the extrudate downstream of the die to the velocity at the die, is suitably in excess of 1.5 and is more suitably at least 20.

In order to preserve the low density structure of the extrudate the exertion thereon of draw down tensile force should not involve the application of lateral crushing forces, as would be the case were the extrudate to be nipped between a pair of opposed draw down rollers. We have found that an effective manner of drawing down the extrudate with preservation of the low density structure thereof is for the extrudate, while at a sufficiently high temperature to ensure surface tackiness, to extend about a driven roller. By ensuring an adequate degree of tackiness of the extrudate and contact between the extrudate and the roller over a sufficient proportion of the circumference of the roller, the roller exerts a tractive force on the extrudate sufficient to draw down the extrudate. Suitably the peripheral contact surface of the roller is of plain cylindrical and smooth form. The position of the roller relative to the extruder die is advantageously such that the extrudate in the travel thereof from the die to the roller has not cooled sufficiently to prevent the extrudate from being tacky enought to adhere adequately to the roller. In order to ensure adequate tackiness of the extrudate at the location of the roller, the run of the extrudate from the extruder die to the roller may be subjected to heating by, for example, the run being enclosed in a housing which is associated with heating means operable to maintain the interior of the housing at an elevated temperature. The provision of heating in this manner may also be advantageous in prolonging the residence time of the extrudate in the plastic phase.

At a given die exit temperature of the extrudate and a given formulation of components fed to the extruder, the degree of draw down to which the extrudate is subjected should be so selected that the interior cells of the extrudate become elongated without the cells rupturing at, and fracturing the widthwise surfaces of the extrudate.

At the cutting stage of the sheet form extrudate the temperature of the extrudate should advantageously be low enough to ensure that the extrudate is insufficiently tacky to cause problems in the operation of the cutter and also to ensure that the cellular structure of the extrudate has become adequately consolidated for the cells to exhibit a pneumaticity requisite for the cells to resist the cutting forces, which forces might otherwise crush a significant proportion of the cells. It is convenient in this regard to subject the extrudate to the cooling action of cooling means. Advantageously, a draw down roller may be adapted to provide the cooling means, provision being made for a coolant fluid to circulate through the roller.

Suitably, the temperature of the extrudate at the cutting stage is within a range of 30° C. to 50° C.

Advantageously, the sheet form extrudate is first operated upon at the cutting stage to slit the extrudate longitudinally, i.e. in the machine direction. For this purpose there may be provided a multiplicity of slitting elements, disc knives for example, closely spaced transversely of the extrudate. The extrudate is next operated upon by severing means, a multi-bladed cylinder cutter for example, so that the cut product takes the form of filaments of rectilinear cross-section.

We have found that to best ensure that the cut product is of uniform structure there should be employed a die the exit orifice of which is such that the extrudate upon first issuing from the die is of tubular or near-tubular cross-section. The extrudate is then opened to provide a flat sheet of uniform interior structure and uniform thickness. An alternative die exit orifice is of a straight slit configuration.

As will be readily appreciated by those skilled in the tobacco reconstitution art, possibilities arise for feeding flavorant materials to the extruder. Such materials may be nature-identical or artificial flavorants or botanical extracts.

The particulate tobacco used in the subject inventive process can be derived from the stem and/or the lamina portions of tobacco leaf and can be tobacco factory offal. We have found that the process can be fully adequately performed using offals in the condition as accumulated from any location in the primary or secondary manufacturing processes of a tobacco factory. Alternatively or in addition to offals cut tobacco can be used.

By use of the inventive process there is readily obtained product the constituents of which have undergone substantially no chemical change relative to the chemical constitution thereof when fed to the extruder.

The present invention also provides reconstituted-tobacco filler product consisting of particles each of which particles comprises a cellular interior and an integral skin extending over each of two opposite sides of the particle, the filler product having been made by a process wherein a mixture of particulate tobacco, starch and binder, of which mixture starch constitutes 5% to 35% by weight, binder constitutes up to 10% by weight and the amount of starch is, by weight, twice or more the amount of binder, with the addition of sugar within a range of 0% to 10% by weight of said mixture, and with the addition of water, is extruded, to provide a sheet form extrudate, under such extrusion conditions that the extrudate assumes a cross-section greater than that of the exit orifice of the extruder die, and the extrudate is cut to provide said particles.

Suitably, the binder comprises a cellulosic binder. The reconstituted-tobacco filler product should exhibit a replacement value for natural, i.e. un-reconstituted, and unexpanded tobacco filler of at least 1:1.

In order that the present invention may be clearly understood and readily carried into effect reference will now be made, by way of example, to the drawing hereof, in which.

Figures 1, 2:
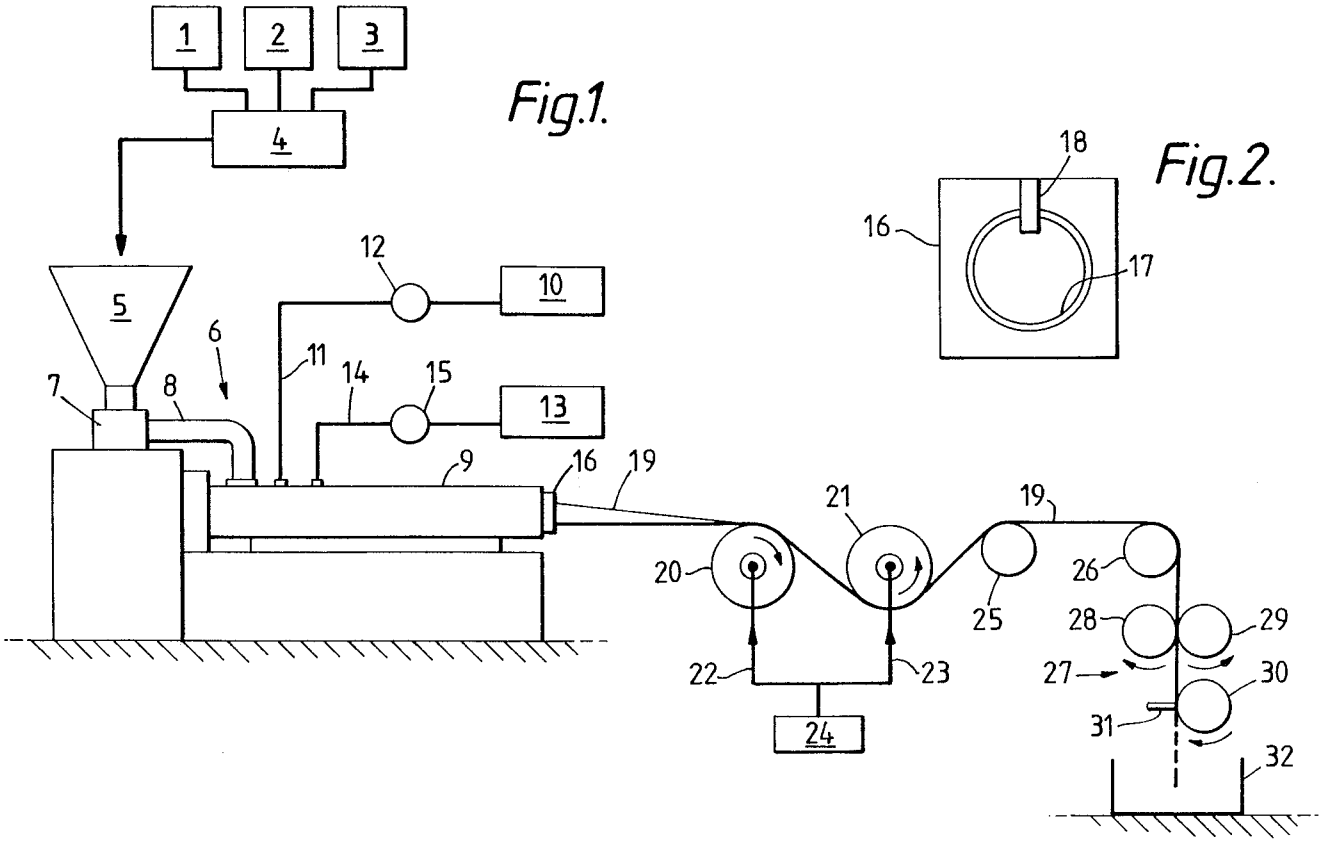
FIG. 1 shows a schematic of tobacco reconstitution apparatus.
FIG. 2 shows diagrammatically an outlet end view of the die of an extruder of the apparatus of FIG. 1.

In operation of the apparatus shown schematically in FIG. 1 to produce a reconstituted tobacco product, tobacco offal, starch and cellulosic binder are fed respectively from bins 1, 2 and 3 to a mixer unit 4, wherein the components are mixed without the addition of water. The formulation by weight of the mixture may be, for example, 80% tobacco offal, 15% starch and 5% cellulosic binder. Factory offal may be readily used without any requirement for the offal to be ground. The cellulosci binder may, for example, be constituted by three parts by weight hydroxypropyl cellulose (obtained from Aqualon BV) and two parts by weight sodium carboxymethyl cellulose (obtained from Courtaulds plastics and chemicals).

After the components have been thoroughly mixed in the mixer unit 4, the mixture is fed to hopper 5 of a twin-screw extruded generally designated by reference numeral 6. A feed unit 7 of the extruder 6 serves to feed the mixture through a feed pipe 8 to the inlet end of barrel 9 of the extruder 6. Water drawn from a tank 10 is injected into the barrel 9 through a line 11 under the action of a pump 12. Similarly, glycerol is drawn from a tank 13 and injected into the barrel 9 through a line 14 under the action of a pump 15.

If an addition of sugar is to be included, the sugar is conveniently fed to the mixer unit 4 with the materials from bins 1–3.

The flow rate of mixture to the barrel 9 from the hopper 5 may be, for example, 86 kg per hour, in which case the flow rates of water and glycerol through the lines 11 and 14 are suitably 10 and 5 kg per hour respectively. The total water in the wet mix in the barrel 9 may, for example, represent 16% by weight of the wet mix.

The barrel 9 is provided with heating means (not depicted in FIG. 1) by the operation of which a desired temperature profile can be maintained along the barrel 9. The barrel temperature may, for example, be maintained at 40° C. at the inlet end increasing to 95° C. at the outlet end.

The pressure within the extruder must be maintained at a high enough value to ensure that water therein remains in the liquid phase. We have found that a pressure within a range of 500 psig (3400 kPa) to 2000 psig (13600 kPa) is suitable.

At these temperaturees and pressures the starch fed to the extruder is caused to gelatinize.

At the outlet end of the barrel 9 of the extruder 6 there is mounted an extruder die 16. AS can be seen from FIG. 2, the exit orifice of the die 16, designated by reference numeral 17, is of generally ring form. The orifice 17 does not have the form of a complete ring in that a block 18 set into the die 16 interrupts the orifice 17 at the twelve o'clock position thereof. Thus the extrudate, designated by reference numeral 19, when first issuing from the die 16 is of near-tubular cross-section.

As the extrudate 19 issues from the die 16 water in the extrudate 19 flashes off to steam, as a result of which the cross-section of the extrudate 19 becomes greater than the cross-section of the exit orifice 17 of the die 16 and there is imparted to the extrudate 19 a substantially closed cell interior structure. The temperature of the extrudate 19 when measured adjacent the die 16 has been found to be typically 115° C.

The extrudate 19 is passed about two plain cylindrical rollers 20 and 21, each of which comprises a polished, stainless steel peripheral surface. Roller 20 is driven in a clockwise direction and roller 21 is an anticlockwise direction as viewing FIG. 1, roller 21 being driven at the same speed as roller 20. Chilled water is circulated through the rollers 20 and 21, via lines 22 and 23 respectively, from a chilling and pumping unit 24.

In the passage thereof from the die 16 to the roller 20, the extrudate 20 is opened from the near-tubular form at the die 16 to a flat sheet form at the roller 20. The temperature of the extrudate 19 in contact with the roller 20 is such that the extrudate 19 is tacky and thus adheres to the surface of the drum 20 so that the drum 20, which is driven with a peripheral velocity in excess of the linear velocity of the extrudate 19 at exit from the die 16, exerts a tractive force on the extrudate 19 and draws down the extrudate 19. The draw down ration may be, for example, ten.

The cooling effect of the chilled water circulated through the rollers 20 and 21 reduces the temperature of the sheet form extrudate 19 so that the temperature thereof upon passing from the roller 21 is, for example, 40° C. The extrudate 19 passing from the roller 21 is of uniform width and thickness, 200 mm. and 0.7 mm. for example, and of a uniform structure across the section of the extrudate 19, which structure comprises a closed cell interior and upper and lower outer skins. As a result of the draw down to which the extrudate 19 is subjected while in the plastic phase thereof upstream of the roller 20, the cells within the extrudate 19 are elongated in the machine direction. As a result of the cooling action of the rollers 20, 21, the machine direction oriented structure of the extrudate 19 is consolidated. The extrudate 19 passing from the roller 21 is, as a result of the drawing down and consolidation processes, of enhanced strength and flexibility.

Downstream of the roller 21 the sheet form extrudate 19 passes about guide rollers 25 and 26 before entering a cutter unit generally designtaed by refernce numeral 27. Upon entering the cutter unit 27 the extrudate 19 first passes between a pair of slitters 28 and 29 each of which is comprised of a multiplicity of rotatably driven disc knives. The slitters 28, 29 serve to slit the extrudate into continuous filaments of a width of, for example, 0.8 mm. The now filamentary extrudate passes between a multi-bladed, rotatably driven cylinder 30 and a cooperating stationary blade 31, whereby the continuous filaments are severed to provide discrete filaments of a length of, for example, 40 mm., which discrete filaments are collected in a skip 32.

Typically, the moisture content of the filaments as collected is 15% by weight.

The product collected in the skip 32 is eminently suitable for blending with natural tobacco cigarette filler. Moreover, the blending can take place at the conclusion of the primary processing steps of tobacco manufacture, this being in contradistinction to currently available reconstituted products which have to be passed through the primary processing steps and are therein subject to degradation.

Alternative formulations on a dry weight basis of particulate materials which may be fed to an extruder in carrying out the process of the present invention are as follows.

FORMULATIONS I

Tobacco 80%, Starch 15%, Hydroxypropyl Cellulose 3%, Sucrose 2%.

FORMULATION II

Tobacco 76%, Starch 15%, Hydroxyethyl Cellulose 3%, Carboxymethyl Cellulose 2%, Sucrose 4%.

Products obtained by the process of the present invention have been found to possess a combination of properties, including smoking character, superior to the products of previously practised tobacco reconstitution processes.

Products produced by use of the inventive process have been found to be of excellent appearance and natural colour and aroma. Quantitative tests have shown that the colour shift of the products from the initial dry mixes fed to the extruder are minimal. Other tests have shown that the levels of nicotine and total and reducing sugars in the products are similar to those of the tobacco as fed to the extruder.

Products of filling power equivalent to or in excess of that of unexpandes cut leaf tobacco are readily produced by the inventive process.

What is claimed is:

1. A tobacco reconstitution process, wherein a mixture of particulate tobacco, starch and binders, of which mixture starch constitutes 5% to 35% by weight, binder constitutes up to 10% by weight and the amount of starch is, by weight, twice or more the amount of binder, with the addition of water, is extruded in an extruder comprising a die provided with an exit orifice, to provide a sheet form extrudate comprising a cellular interior structure, under such conditions that water in said extruder is in the liquid phase and immediately upon issuing from said die the water flashes off to steam causing the extrudate to expand and assume a cross-section greater than that of said exit orifice, and the extrudate is cut to provide a product of tobacco-filler size particles.

2. A process as claimed in claim 1, wherein said starch is present in said mixture at a level of at least 10% by weight.

3. A process as claimed in claim 1, wherein said starch is present in said mixture at a level not exceeding 30% by weight.

4. A process as claimed in claim 1, wherein said starch is present in said mixture in an amount by weight exceeding the presence in said mixture of said binder by at least three times.

5. A process as claimed in claim 1, wherein said binder comprises a cellulosic binder.

6. A process as claimed in claim 5, wherein a proportion at least of said binder is hydroxypropyl cellulose.

7. A process as claimed in claim 1, wherein the moisture content of the cut extrudate is within a range of 5% to 20% by weight on a wet basis.

8. A process as claimed in claim 7, wherein said moisture content is within a range of 10% to 16% by weight on a wet basis.

9. A process as claimed in claim 1, wherein the maximum temperature of said tobacco in said extruder is within a range of 80° C. to 180° C.

10. A process as claimed in claim 1, wherein temperature and pressure conditions in said extruder are such that upon said extrudate issuing from said die, the extrudate is expanded by water therein flashing off to steam.

11. A process as claimed in claim 1, wherein the density of said extrudate is within a range of 50 mg/cc to 500 mg/cc.

12. A process as claimed in claim 1, wherein said mixture additionally contains up to 10% by weight, sugar.

13. A tobacco reconstitution process, wherein a mixture of particulate tobacco, starch and binder, of which mixture starch constitutes 5% to 35% by weight, binder constitutes up to 10% by weight and the amount of starch is, by weight, twice or more the amount of binder with the addition of water, and a plasticizer is extruded in an extruder comprising a die provided with an exit orifice, to provide a sheet form extrudate comprising a cellular interior structure, under such conditions that water in said extruder is in the liquid phase and immediately upon issuing from said die the extrudate expands to assume a cross-section greater than that of said exit orifice, and the extrudate is cut to provide a product of tobacco-filler size particles.

14. A tobacco reconstitution process, wherein a mixture of particulate tobacco, starch and binder, of which mixture strach constitutes 5% to 35% by weight, binder constitutes up to 10% by weight and the amount of starch is, by weight, twice or more the amount of binder, drawn down, thus to effect an increase in the machine dimension thereof with the addition of water, is extruded in an extruder comprising a die provided with an exit orifice, to provide a sheet form extrudate comprising a cellular interior structure, under such conditions that water in said extruder is in the liquid phase and immediately upon issuing from said die the extrudate expands to assume a cross-section greater than that of said exit orifice, and the extrudate is cut to provide a product of tobacco-filler size particles.

15. A process as claimed in claim 14, wherein the draw down ratio is in excess of 1.5.

16. A process as claimed in claim 15, wherein said draw down ratio is at least 20.

17. A tobacco reconstitution process, wherein a mixture of particulate tobacco, starch and binder, of which mixture starch constitutes 5% to 35% by weight, binder constitutes up to 10% by weight and the amount of starch is, by weight, twice or more the amount of binder, with the addition of water, is extruded in an extruder comprising a die provided with an exit orifice, to provide a sheet form extrudate comprising a cellular interior structure, under such conditions that water in said extruder is in the liquid phase and immediately upon issuing from said die the extrudate expands to assume a tubular or near tubular form and being opened to provide a sheet of uniform thickness and cross-section greater than that of said exit orifice, and the extrudate is cut to provide a product of tobacco-filler size particles.

* * * * *

UNITED STATES PATENT AND TRADEMARK OFFICE

CERTIFICATE OF CORRECTION

PATENT NO. : 4,977,908

DATED : December 18, 1990

INVENTOR(S) : Luke, John A.

It is certified that error appears in the above-identified patent and that said Letters Patent is hereby corrected as shown below:

Column 1, line 52, after "U.S. Pat." insert -- specifications --.

Column 5, line 27, delete "cellulosci" and insert therefor -- cellulosic --.

Column 5, line 31, delete "plastics and chemicals)." and insert therefor -- Plastics and Chemicals). --

Column 6, line 53, after "cutter unit generally" delete "designtaed by refernce" and insert therefor -- designated by reference --.

Column 7, line 33, after "that of", delete "unexpandes" and insert therefor -- unexpanded --.

Column 7, line 37, after "tobacco, starch and" delete "binders" and insert therefor -- binder --.

Column 8, line 4, Claim number "9" should be correctly numbered -- 10 --.

Column 8, line 7, claim number "10" should be correctly numbered -- 11 --.

Column 8, line 12, claim number "11" should be correctly numbered -- 12 --.

Column 8, line 15, claim number "12" should be correctly numbered -- 17 --.

Column 8, line 18, claim number "13" should be correctly numbered -- 9 --.

UNITED STATES PATENT AND TRADEMARK OFFICE

CERTIFICATE OF CORRECTION

PATENT NO. : 4,977,908

DATED : December 18, 1990

INVENTOR(S) : Luke, John A.

It is certified that error appears in the above-identified patent and that said Letters Patent is hereby corrected as shown below:

Column 8, line 32, claim number "14" should be correctly numbered -- 13 --.

Column 8, line 34, after "mixture" delete "strach" and insert therefor -- starch --.

Column 8, line 47, claim number "15" should be correctly numbered -- 14 --.

Column 8, line 47, after "as claimed in claim" delete "14" and insert therefor -- 13 --.

Column 8, line 49, claim number "16" should be correctly numbered -- 15 --.

Column 8, line 49, after "as claimed in claim" delete "15" and insert therefor -- 14 --.

Column 8, line 51, claim number "17" should be correctly numbered -- 16 --.

Signed and Sealed this

Twenty-second Day of December, 1992

*Attest:*

DOUGLAS B. COMER

*Attesting Officer*

*Acting Commissioner of Patents and Trademarks*